US005258818A

United States Patent [19]

Sundquist et al.

[11] Patent Number: 5,258,818

[45] Date of Patent: Nov. 2, 1993

[54] PHOTOCOPIER WITH DUPLEX TRAY SAVE AFTER JAM

[75] Inventors: Douglas F. Sundquist, Webster; Paul F. Schmitt, Palmyra; Charles E. Smith; Riley L. Warddrip, both of Pittsford, all of N.Y.; Thomas M. Spangenberg, Wellesley, Mass.

[73] Assignee: Xerox Corporation, Stamford, Conn.

[21] Appl. No.: 843,326

[22] Filed: Feb. 28, 1992

[51] Int. Cl.[5] ..... G03G 21/00

[52] U.S. Cl. ..... 355/321; 271/184; 271/225; 355/319

[58] Field of Search ..... 355/308, 309, 319, 321, 355/322, 318; 271/3, 3.1, 225, 258, 184, 186

[56] References Cited

U.S. PATENT DOCUMENTS 4,338,023 4/1982 McGibbon ..... 355/206
4,816,872 3/1989 Okamoto et al. ..... 355/23
5,030,991 7/1991 Zaitsu et al. ..... 355/207
5,081,490 1/1992 Wakao ..... 355/206
5,105,229 4/1992 Ozaki ..... 355/313

*Primary Examiner*—Leo P. Picard
*Assistant Examiner*—Christopher Horgan
*Attorney, Agent, or Firm*—Ronald F. Chapuran

[57] ABSTRACT

A method of recovery from a machine paper jam with a plurality of sheets in a duplex tray of a machine operating in a pre-collation mode to provide multiple copy sets, including the steps of recycling the plurality of pre-collated or pre-ordered serial sheets in the duplex tray out of and back into the duplex tray to reorient the images on the sheets, reimaging the sheets that have exited the duplex tray but are still in process, stacking the reimaged sheets into the top of the duplex tray and recycling a second time the plurality of sheets originally in the duplex tray at time of jam into the duplex tray to reorient the images on the sheets for a second time.

7 Claims, 5 Drawing Sheets

PHOTOCOPIER WITH DUPLEX TRAY SAVE AFTER JAM

The invention relates to machine paper jam recovery, and more particularly, to a system for minimizing copy sheet waste due to duplex tray buffering in pre-collation mode of operation.

In using reproduction machines, there are various types of system shut downs or malfunctions that can occur in the various operating modes. Operator involvement in correcting for malfunctions and maintaining the integrity of the run in process can be a significant problem. For example, jammed copies are often damaged and require removal before the machine can be restarted. Other copies are at various stages of completion. The loss of damaged copies and the need to recover partially completed copies interferes with the normal sequence of the reproduction run and it is often necessary to restart the reproduction run or to makeup for the copies in process to be able to continue.

There are various types of recovery procedures, both automatic and manual, in the prior art for recovery for various types of system shutdowns. U.S. Pat. No. 4,338,023 assigned to the same assignee as the present invention, teaches a hierarchy of job recovery sequences in a reproduction machine having a duplex capability.

A drawback of the prior art techniques for job recovery has been the need to purge copy sheets from the duplex tray and then to replace the sheets with new copies to be able to continue operation. This is inefficient from the standpoint of wasting valuable copy paper, and often inefficient from the standpoint of thru put and productivity of the machine. In addition, when partially completed copy sheets are purged to the top tray of the machine, the operator must take time to gather and dispose of these discarded sheets.

It would, therefore, be desirable to provide a sophisticated, efficient, automatic job recovery system that minimizes operator intervention and maximizes the use of copies in process. In particular, it would be desirable to provide a malfunction detection and job recovery system involving automatic job recovery procedures within the machine itself and salvaging as many copies in process as possible.

It is an object of the present invention, therefore, to provide a means to save partially completed copy sheets after a jam, and in particular, to save and reuse copy sheets situated in a duplex copy sheet tray. It is another object of the present invention to provide a technique to save partially completed copy sheets after a jam and in particular a technique that can be retrofit into an existing control and requires no additional hardware changes. Further advantages of the present invention will become apparent as the following description proceeds and the features characterizing the invention will be pointed out with particularity in the claims annexed to and forming a part of this specification.

SUMMARY OF THE INVENTION

Briefly, the present invention is a method of recovery from a machine paper jam, with a plurality of sheets in a duplex tray of a machine operating in a pre-collation mode to avoid purging the duplex tray sheets, including the steps of recycling the plurality of sheets in the duplex tray out of and back into the duplex tray to reorient the images on the sheets, reimaging the sheets that have exited the duplex tray but are still in process, stacking the reimaged sheets into the top of the duplex tray and recycling a second time the plurality of sheets originally in the duplex tray at the time of a jam to reorient the images on the sheets for a second time.

For a better understanding of the present invention, reference may be had to the accompanying drawings wherein the same reference numerals have been applied to like parts and wherein:

IN THE DRAWINGS

DETAILED DESCRIPTION OF THE INVENTION

Figure 1:
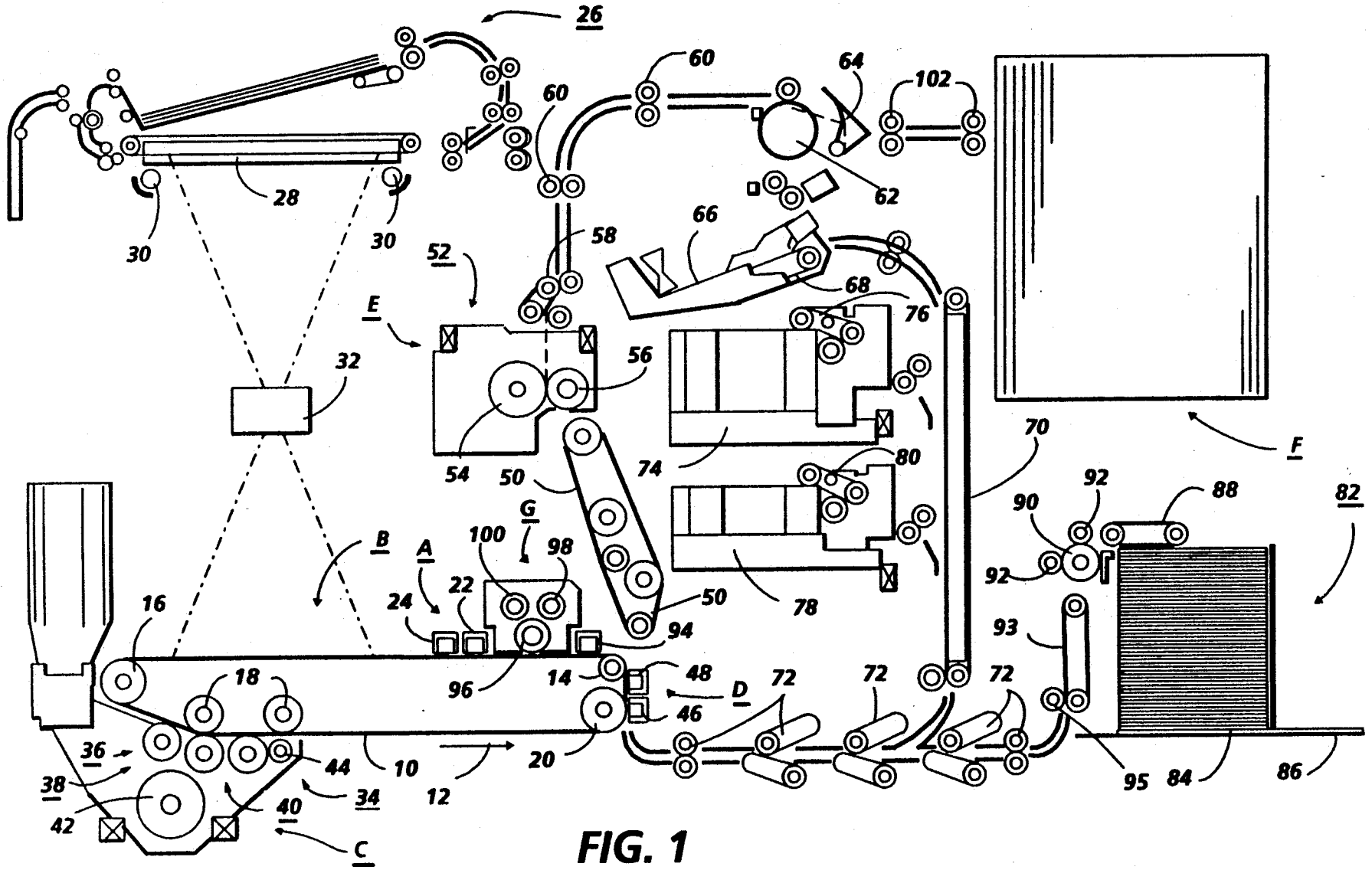
FIG. 1 is a schematic elevational view depicting various operating components and sub-systems of a machine incorporating the present invention.

Referring to FIG. 1, there is shown a typical electrophotographic reproduction machine composed of a plurality of programmable components and sub-systems which cooperate to carry out the copying or printing job programmed through a touch dialogue User Interface (U.I.). It should be noted that various types of reproduction and printing machines are contemplated to incorporate the present invention, FIGS. 1 and 2 being merely exemplary. The machine, incorporating the present invention employs a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24, charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on a photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detach the copy sheet from belt 10.

Following transfer, a conveyor 50 advances the copy sheet bearing the transferred image to fusing station E where a fuser assembly, indicated generally by the reference numeral 52, permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F via transport 102 or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which, in cooperation with idler roll 95 and rolls 72, move the sheet to transfer station station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of the machine are regulated by a controller which preferably comprises one or more programmable microprocessors. The controller provides a comparison count of the copy sheets, the number of documents being recirculated, the number of copy sheets selected by the operator, time delays, jam corrections, etc.. As will appear, programming and operating control over the machine is accomplished through a User Interface. Operating and control information, job programming instructions, etc. are stored in a suitable memory which includes both ROM and RAM memory types. Conventional sheet path sensors or switches may be utilized to keep track of the position of the documents and the copy sheets. In addition, the controller regulates the various positions of the gates depending upon the mode of operation selected. For more detail of operation, reference is hereby made to U.S. Pat. No. 5,023,817 incorporated herein.

In the prior art, when a jam occurs in the paper path in a pre-collation job requirement with copy sheets in the duplex tray at the time of jam, the usual recovery procedure in the prior art is to purge the sheets remaining in the duplex tray to an output tray to be discarded. The system would then remake or rebuild the copy sheets in the duplex tray as existed before the jam to continue the operation after the jam had been cleared.

The need to purge the duplex tray copy sheets is because, in the usual operation, copy sheets are delivered to the duplex tray on top of the existing stack and sheets are fed from the tray from the bottom of the stack. Therefore, in order to recover from a paper jam in the system, and still be able to use the copy sheets existing in the duplex tray, it would be necessary to remake the sheets that have exited the duplex tray and insert them under the stack of sheets already in the duplex tray. Since this had been a practical impossibility in the prior art, it was necessary for the duplex tray to be purged.

In accordance with the present invention, this practical impossibility is circumvented by a technique of recycling the copy sheets in the duplex tray. In particular, in a specific embodiment, the copy sheets remaining in the duplex tray at the time of a jam are generally image side down or face down in the tray. To avoid the necessity of purging the sheets, a three step operation is performed. First, the copy sheets remaining in the duplex tray are recycled to reorient the copy sheets in the duplex tray image side up or face up. Next, the copy sheets that already had exited the duplex tray at the time of the jam are re-made or re-copied and placed on top of the duplex tray in a face down orientation as in normal operation. Finally, the copy sheets that were originally in the duplex tray that are now face up in the tray are recirculated out of and back into the duplex tray. They will then be on top of the re-copied or re-made copy sheets in the duplex tray and will be inverted to a face down orientation. The machine is then ready to operate to resume completion of the job, with none of the sheets that had existed at the time of jam in the duplex tray being purged, and these copy sheets being in correct orientation to maintain the integrity of the job.

Figure 2:
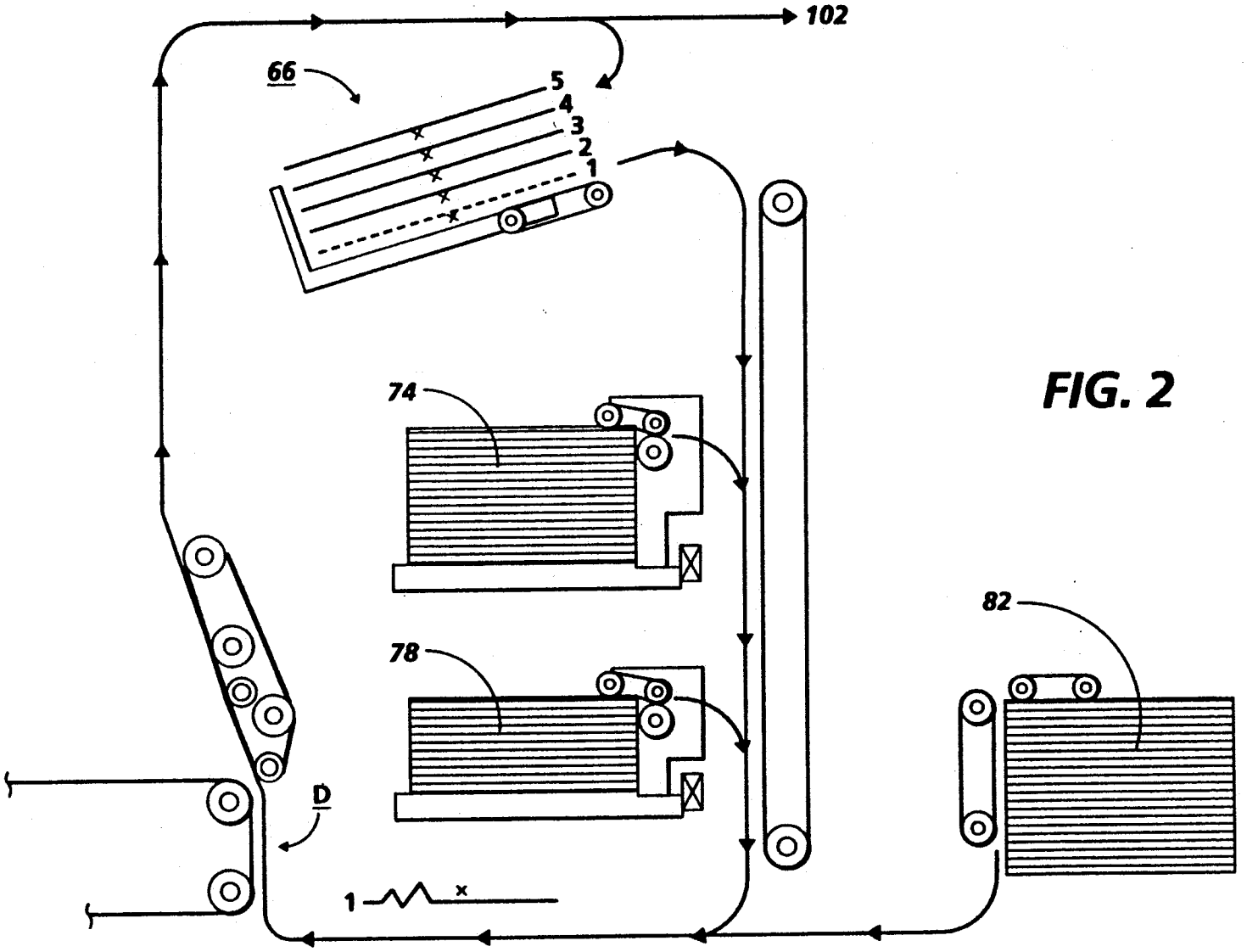
FIGS. 2–4 illustrate the jam recovery technique for salvaging copy sheets in accordance with the present invention.
Figure 3:
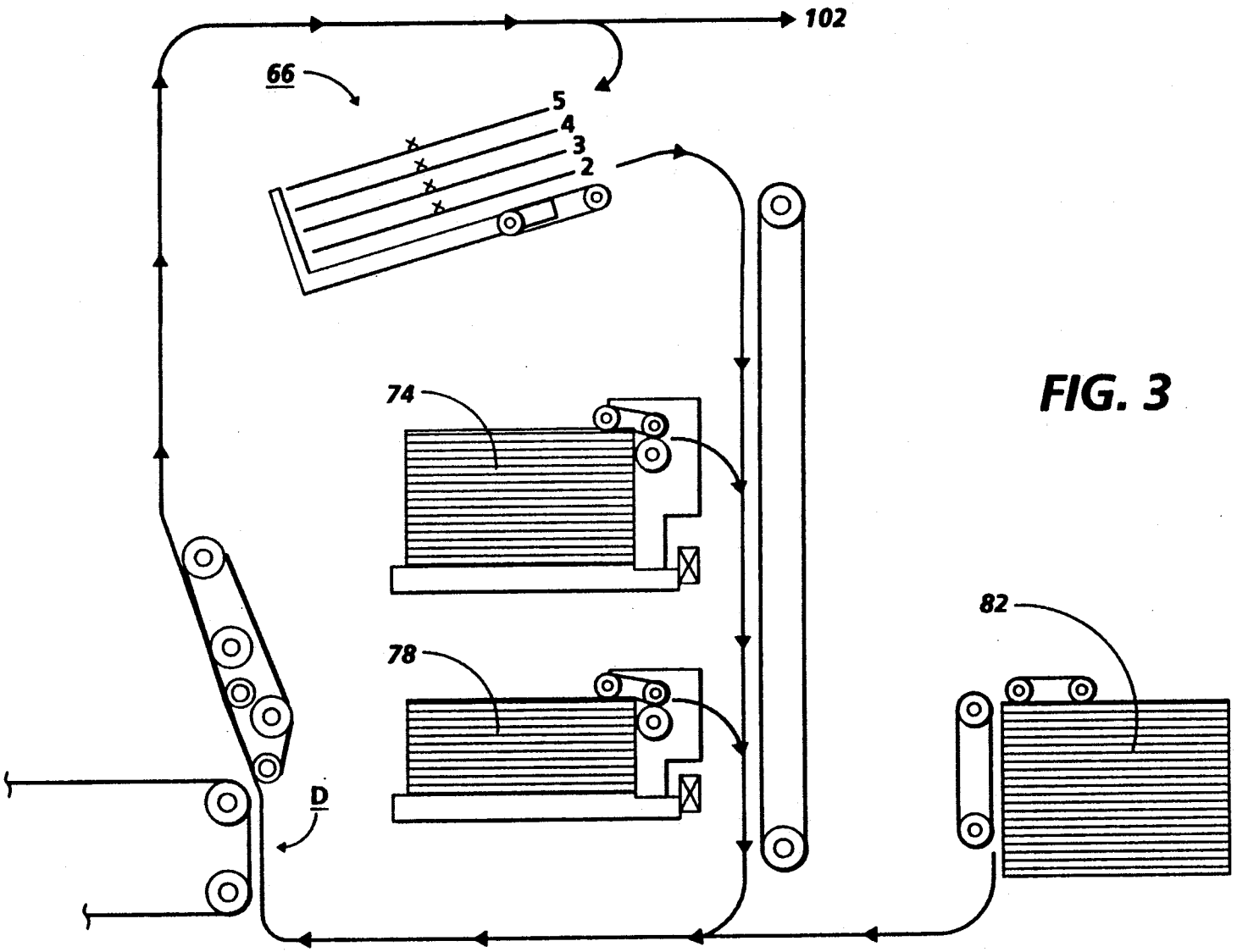
Figure 4:
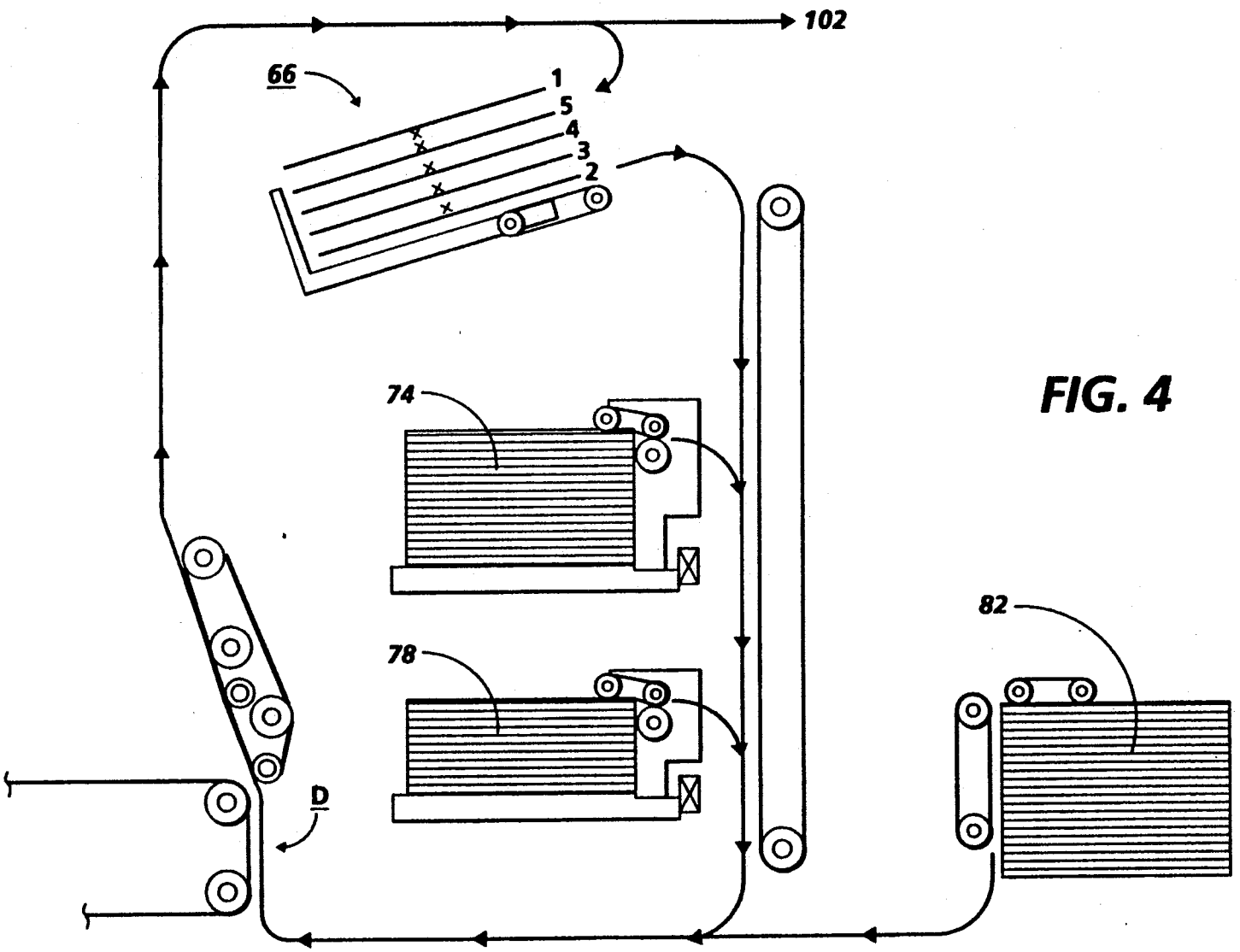

This procedure is more clearly illustrated with reference to FIGS. 2, 3, and 4. With reference to FIG. 2, there is generally illustrated the duplex tray 66, the transfer station D in the copy sheet path as well as secondary tray 74, auxiliary tray 78, and high capacity feeder 82, various sources of copy sheets. There are illustrated four copy sheets in the duplex tray shown by the numbers 2, 3, 4 and 5 with the "X" identifying the side of the copy sheet containing an image. At the bottom of the FIG. 2 is shown copy sheet 1 that has exited the duplex tray 66 and is being transported in the direction of the transfer station D. Copy sheet 1 is also indicated as being the copy sheet that is jammed, thus creating the need to clear the jam and to reconstruct and reorder the copy sheets in the duplex tray 66.

It should be noted that although copy sheet 1 is indicated to be the copy sheet causing the jam, any other sheet in the copy path coming from one of the copy sheet sources on the way to finishing station F via transport 102 could be subject to a jam. As is well known in the art, since it is usually necessary to remove one or several sheets in the machine in order to continue non-malfunctioning operation of the machine, the removed sheets must be re-imaged or re-made for the operation to continue.

Assuming for illustrative purposes, that copy sheet 1 is the only sheet that causes a jam and the only sheet that has to be removed to continue operation, the focus of the remaining description will be on the duplex tray 66 and the technique to reuse sheets 2, 3, 4 and 5 within the duplex tray without the necessity of having to purge copy sheets 2, 3, 4 and 5 from the duplex tray to be totally discarded. Copy sheet 1 has already exited duplex tray 66 and is shown in phantom. The first step in job recovery after jam clearance is to feed all of the copy sheets in the duplex tray from the duplex tray through the transfer station without receiving an image and back onto the top of the duplex tray stack. This causes an inversion of the images on all the copies in the duplex tray as illustrated in FIG. 3. With reference to FIG. 3, it is shown that the copy sheets 2, 3, 4 and 5 are in the same order as in FIG. 2 since the copy sheets are fed from the bottom of the duplex tray 66 and rotated around back into the top of the stack. The only difference is that the image or the X-indication is now on top of the sheet rather than at the bottom of the sheet. It should be noted that for illustrative purposes, four sheets are shown in the duplex tray. It should be understood that in complex multi-document job requirements, normally there would be a large number of copy sheets within the duplex tray up to the capacity limits of the duplex tray, in one embodiment 250 sheets.

Again with reference to FIG. 3, since copy sheet 1 has been discarded, it is now necessary to recreate copy sheet 1 and directly insert copy sheet 1 in proper sequence in the duplex tray with sheets 2, 3, 4 and 5 in order to continue operation of the machine. As is well known in prior art machines, the control monitors the paper path and re-images the copy sheets needed to replace those removed because of the paper jam. A replacement for copy sheet 1 is imaged in normal machine operation and conveyed to the duplex tray 66 at the top of the stack as illustrated in FIG. 4. As shown in FIG. 4, copy sheet 1 is at the top of the stack with the image on the bottom side of the sheet as illustrated, whereas copy sheets 2, 3, 4 and 5 have their image side face up due to the previous recycling of these copy sheets.

The correct orientation of sheets 1–5 is accomplished by again recycling copy sheets 2, 3, 4 and 5 out of the duplex tray around the paper path without receiving an image and back to the top of the stack. Since sheets are bottom fed from the duplex tray, copy sheet 2 will be the first copy sheet circulated back into the top of the stack on top of copy sheet 1, followed by sheets 3, 4, and 5. Since the copy sheets 2, 3, 4 and 5 are being recirculated, the image of these sheets will again be inverted and, in fact, the image will be face down on the bottom side of the copy sheets when they re-enter the duplex tray. The result will be as shown in FIG. 2, with copy sheet 1 now being at the bottom of the tray rather than as shown in phantom in FIG. 2 with sheets 2, 3, 4 and 5 in sequence of top of sheet 1.

The machine is now ready to continue operation with the sheets in the duplex tray properly positioned and oriented to receive side 2 images. It should be understood that the document handling unit 26 has suitably re-ordered the documents in the document stacking and holding tray to register documents on platen 28 in synchronization with the copy sheets fed from the duplex tray 66. That is, the document being imaged at platen 28 is the correct image for the second side of the copy sheet fed from duplex tray 66.

For example, in the embodiment described above, the first sheet to leave the duplex tray upon commencing operation is sheet 1 with a side 1 image. The first document to be fed to the platen 28 upon commencing operation is the document that provides the correct side 2 image for sheet 1 advancing from the duplex tray. The above description relating to sheet 1 is exemplary. After re-ordering the sheets in the duplex tray, any other copy sheet, 2, 3 . . . etc. might at the bottom of the duplex tray to be the first sheet exiting the duplex tray upon commencement of operation. The document handling unit 26 accordingly re-orders the document set to convey the first document and susequent documents to the platen to provide the correct side 2 images to the copy sheets in the duplex tray.

Figure 5:
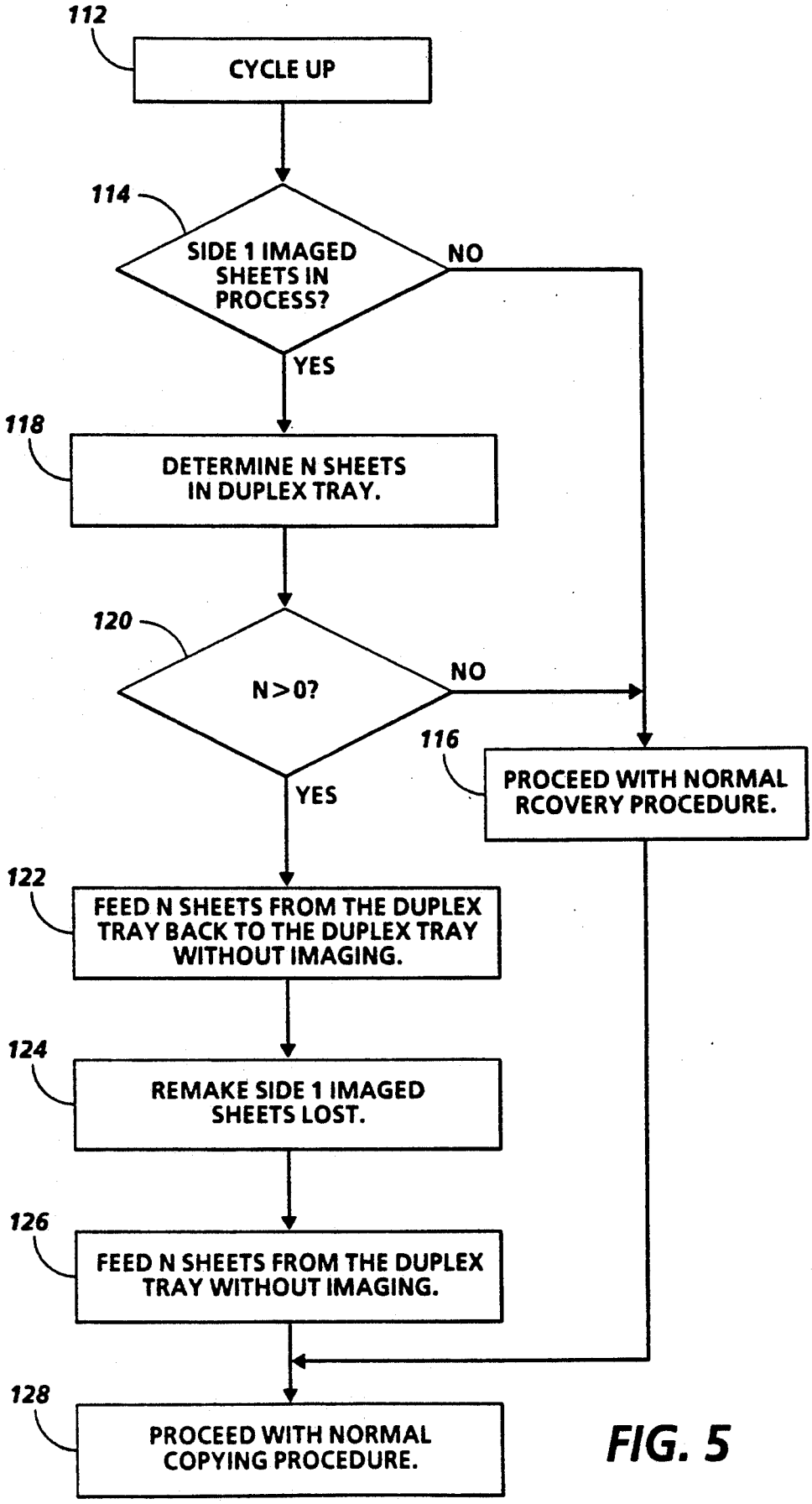
FIGS. 5 is a flow chart showing the recovery technique in accordance with the present invention.

With reference to FIG. 5, there is shown a flow chart illustrating this sequence previously described. Block 112 illustrates cycling up after a jam in a duplex job and assumes that the jam has been corrected and the appropriate copy sheets have been removed. Next, it must be determined if any copy sheets have been fed from the duplex tray 66. These are side 1 imaged sheets still in process in the machine. This is illustrated in the decision block 114. If no, then the system will proceed with a normal copy recovery procedure as illustrated in block 116 which would preclude the need to reorder the copy sheets in the duplex tray.

However, if any image sheets that have been fed from the duplex tray and at least one copy sheet remains in duplex tray 66, it is necessary to determine how many sheets are remaining in the duplex tray, as illustrated at block 118. If no sheets are remaining in the duplex tray, then it is not necessary to follow the procedure to reorder sheets in the duplex tray and the procedure will follow the normal copy recovery procedure 116. If there are an "N" number of copy sheets in the duplex tray, then the first step is to feed "N" sheets from the duplex tray imaging to invert the image side of the sheets in the duplex tray as illustrated by block 122. The inverted sheets are also illustrated in FIG. 3. Block 124 illustrates the remaking of side 1 image sheets lost due to the jam, in particular, copy sheet 1 illustrated in FIG. 2. Finally, block 126 illustrates feeding the "N" sheets from the duplex tray back to the top of the duplex tray without imaging. This again re-inverts the images in the duplex tray and places the recycled sheets on top of the re-made sheets in the duplex tray in proper sequence. The machine then can proceed with the normal copying operation shown at block 128.

While the invention has been described with reference to the structure disclosed, it is not confined to the details set forth, but is intended to cover such modifications or changes as may come within the scope of the following claims.

We claim:

1. In a reproduction machine having a duplex tray and operating in a pre-collation mode to provide multiple copy sets, the method of recovery from a machine paper jam with a plurality of first sheets in the duplex tray, said plurality of first sheets defining one part of a copy set comprising the steps of:

recycling said plurality of first sheets in the duplex tray out of and back into the duplex tray to reorient the images on the sheets, reimaging a given number of second sheets defining another part of said copy set and stacking said given number of second sheets defining another part of said copy set in the duplex tray, and recycling a second time said plurality of first sheets defining said one part of a copy set out of and back into the duplex tray to reorient the images on said plurality of first sheets for a second time.

2. The method of claim 1 including the step of determining the number of copy sheets in a set that have exited the duplex tray prior to the detection of a jam.

3. The method of claim 1 wherein the step of stacking said given number of sheets defining another part of said copy set in the duplex tray includes the step of stacking the sheets on top of the plurality of sheets defining one part of a copy set.

4. In a reproduction machine having a duplex tray to provide a copy set having a given number of copy sheets, the method of recovery from a machine paper jam wherein the status of the machine at the time of the jam detection includes a plurality of sheets in the duplex tray comprising the steps of:

reorienting the plurality of sheets in the duplex tray, reimaging the sheets that exited the duplex tray prior to the jam detection, stacking the reimaged sheets in the duplex tray, and again reorienting the plurality of sheets present in the duplex tray at the time of the jam.

5. A method of recovery from a machine paper jam wherein at the time of the paper jam, the status of the machine includes a first plurality of sheets in a duplex tray of the machine and at least one sheet having exited from the duplex tray including the steps of recycling the plurality of sheets in the duplex tray out of and back into the duplex tray to reorient the images on the sheets, reimaging the sheet that exited the duplex tray, stacking the reimaged sheet onto the top of the duplex tray and recycling a second time the plurality of sheets originally in the duplex tray to reorient the images on the sheets for a second time.

6. In a reproduction machine having a duplex tray and operating in a pre-collation mode to provide multiple copy sets, the method of recovery from a machine paper jam with a plurality of first sheets in the duplex tray at the time of the jam, comprising the steps of:

reimaging second sheets that are not usable due to the jam, stacking the reimaged second sheets in the duplex tray, and reorienting the plurality of first sheets in the duplex tray at the time of the jam with the reimaged second sheets by inverting said plurality of first sheets in the duplex tray to continue machine operation.

7. The method of claim 6 wherein the step of reorienting includes the step of twice recycling the sheets without imaging.

* * * * *